United States Patent [19]

Reinbacher

[11] Patent Number: 5,012,703

[45] Date of Patent: May 7, 1991

[54] CORK REMOVAL APPARATUS

[76] Inventor: Helmut Reinbacher, 20135 Keswick St., Apt., Canoga Park, Calif.

[21] Appl. No.: 474,943

[22] Filed: Feb. 5, 1990

[51] Int. Cl.[5] ..... B67B 7/18

[52] U.S. Cl. ..... 81/3.29; 81/32

[58] Field of Search ..... 81/3.2, 3.29

[56] References Cited

U.S. PATENT DOCUMENTS 4,791,834 12/1988 Federighi ..... 81/3.2

*Primary Examiner*—James G. Smith
*Assistant Examiner*—Lawrence Cruz
*Attorney, Agent, or Firm*—James E. Brunton

[57] ABSTRACT

An improved apparatus for extracting a cork from a bottle, such as a wine bottle.

The device of the invention is designed to remove the cork from the bottle using gas under pressure flowing through a hollow needle adapted to penetrate the cork. The source of gas is a small pressurized gas container, or alternatively, a hand pump which is readily interchangeable with the gas container. The device also includes a safety shield which surrounds the needle so as to prevent accidental needle puncture during operation of the device.

4 Claims, 4 Drawing Sheets

CORK REMOVAL APPARATUS

BACKGROUND OF THE INVENTION

1. Field of the Invention

The present invention relates generally to devices for removing corks from bottles. More particularly, the invention concerns an improved cork extraction device of the character in which the cork is penetrated by a hollow needle and gas under pressure is introduced into the bottle through the needle to force the cork from the opening in the neck of the bottle.

2. Discussion of the Invention

For many years corks were typically removed from bottles, such as wine bottles, through the use of a cork screw. This practice had many drawbacks, including being cumbersome, and inefficient. Additionally, the cork screw would often times break or crumble the cork, contaminating the contents of the bottle.

Because of the drawbacks of the cork screw, several types of devices were suggested for removal of corks from bottles, such as wine bottles, using inert gases under pressure. Many of the devices were both dangerous and difficult to use. Devices of the character using sharp hollow needles to penetrate the cork for insertion of the gas into the bottle were particularly dangerous for several reasons. In the first place, if the device did not include a protective shield for the needle, as was generally the case, serious puncture wounds to the user could result from the unguarded needle during attempted penetration of the cork with the needle. Further, most prior art devices made no provision for safely capturing the cork upon its uncontrolled ejection from the bottle due to the sometimes substantial gas pressure build-up within the bottle. Accordingly, in using such devices serious injury to the user could occur as the cork was ejected from the bottle, often with substantial force. Another drawback of the prior art devices was the failure to provide a safe and easy way to extract the needle from the cork. Once again, the absence of appropriate safety shields resulted in serious injury to the user as a result of accidental needle puncture during the needle extraction process.

Finally, most prior art devices require the use of a small pressurized gas container to provide the gas pressure to cause removal of the cork. When the gas is expended the device is useless until a new container is procured. In the apparatus of the present invention, a hand pump is provided which can be used interchangeably with the pressurized gas container. Accordingly, if no gas container is immediately available the small hand pump can be used as the pressurizing gas source.

Importantly, the improved apparatus of the present invention also overcomes the serious safety deficiencies of the prior art gas pressure generated devices, by providing a safety shield which prevents needle puncture and also functions to safely capture the cork upon its ejection from the bottle.

SUMMARY OF THE INVENTION

It is an object of the present invention to provide an improved apparatus for extracting a cork form a bottle, such as a wine bottle, which is easy and safe to use.

More particularly, it is an object of the invention to provide a cork extraction device in which the cork is removed from the bottle using gas under pressure, flowing through a hollow needle adapted to penetrate the cork. Uniquely, the source of gas can be a small pressurized gas container or a hand pump which is readily interchangeable with the gas container. Further, the device includes a safety shield which surrounds the needle so as to prevent accidental needle puncture during operation of the device.

Another object of the invention is to provide a device of the aforementioned character in which the safety shield also functions to safely capture the cork as it is ejected from the bottle.

A further object of the invention is to provide a device as described in the proceeding paragraphs which is compact, durable, attractive and reliable in operation.

Still another object of the invention is to provide a device of the class described which is of a simple construction, is easy to clean and one which can be inexpensively manufactured

DESCRIPTION OF THE INVENTION

Figure 6:
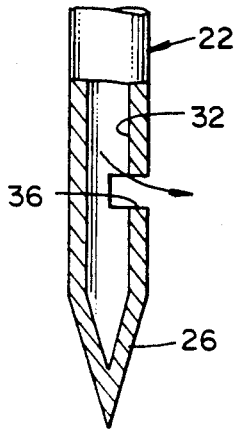
FIG. 6 is an enlarged fragmentary view partly in cross-section illustrating the configuration of the needle portion of the apparatus of the invention.

Referring to the drawings, particularly to FIGS. and 2, one form of the cork removal apparatus of the present invention is there illustrated, and generally designated by the numeral 12. The apparatus of this embodiment of the invention comprises a hollow body 14 having upper and lower ends 16 and 18 respectively; a needle support 20 connected to hollow body 14 proximate the lower end thereof; and an elongated needle 22 having an upper end 24 connected to needle support 20. Needle 22 is provided with a lower, cork penetrating end 26 for penetrating the cork 28 which seals the top of the bottle 30. As best seen by referring to FIG. 6, needle 22 has a longitudinally extending gas passageway 32 having a gas inlet 34 located proximate the upper end thereof and a gas outlet 36 located proximate the lower, cork penetrating end 26.

Figure 8:
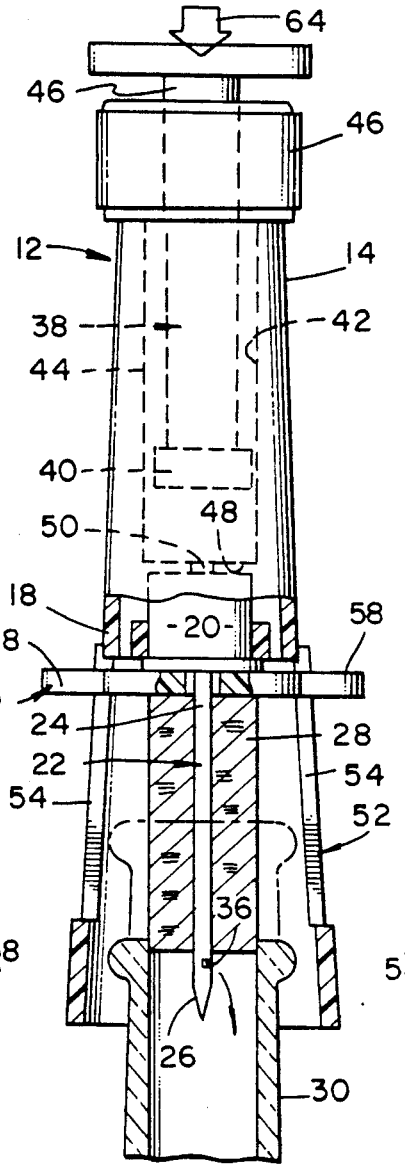
FIG. 8 is a side elevation cross-sectional view similar to FIG. 7, but illustrating the removal of the cork from the bottle by introducing gas under pressure into the bottle.
Figure 19:
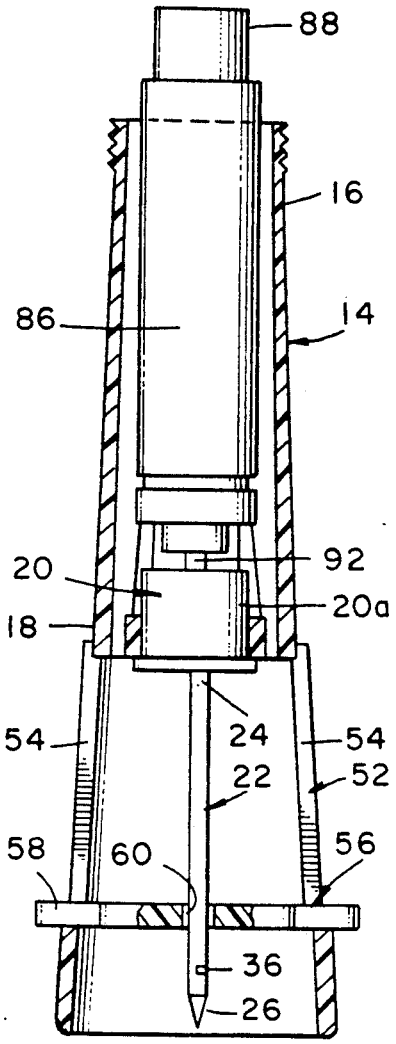
FIG. 19 is a side elevational view, partly in section, taken along lines 19—19 of FIG. 18.

Carried internally of hollow body 14, is a gas supply means for supplying gas under pressure to inlet 34 of hollow needle 22. As will be discussed in greater detail hereinafter, the gas supply means can be a pressurized gas container carried internally of body 14, or alternatively can be a small hand pump which is interchangeable with the gas container. In the embodiment of the invention shown in FIG. 2, the gas supply means comprises a source of gas provided in the form of an air pump 38. In FIG. 19 the gas supply means comprises a pressurized gas container of a character to be described more fully hereinafter. Air pump 38 is of standard construction having a piston 40 which reciprocates within an internal chamber 42 of a housing 44 (FIG. 8). An operating handle 46 is connected to piston 40 and extends upwardly from housing 14 through a cap 46, which is threadably interconnected with body 14 proximate the upper end thereof. Pump 38 is closed by a lower face 48, which includes a tubular gas outlet 50 adapted to be closely received within needle support 20.

Figure 4:
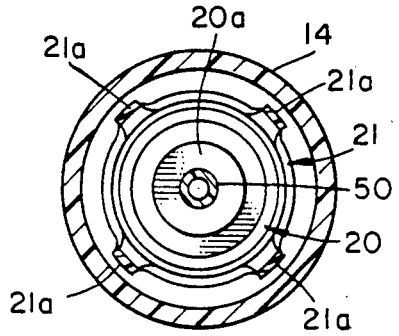
FIG. 4 is an enlarged cross-sectional view taken along lines 4—4 of FIG. 2.

As best seen by referring to FIG. 4, needle support 20 is held in position within body 14 by a support web 21 having upwardly extending legs 21*a* connected to the interior walls of hollow body 14. Needle support 20 also includes an upstanding central portion 20*a* having an axial bore 20*b* adapted to closely receive tubular gas outlet 50. With this construction, when handle 46 is manually moved up and down to cause piston 40 to reciprocate within chamber 42, air under pressure will be forced through gas outlet 50, into passageway 32 of hollow needle 22 and thence outwardly through outlet 36. Downward movement of piston 40 causes air under pressure to be forced into the bottle 30 to effect removal of cork 28.

Figure 1:
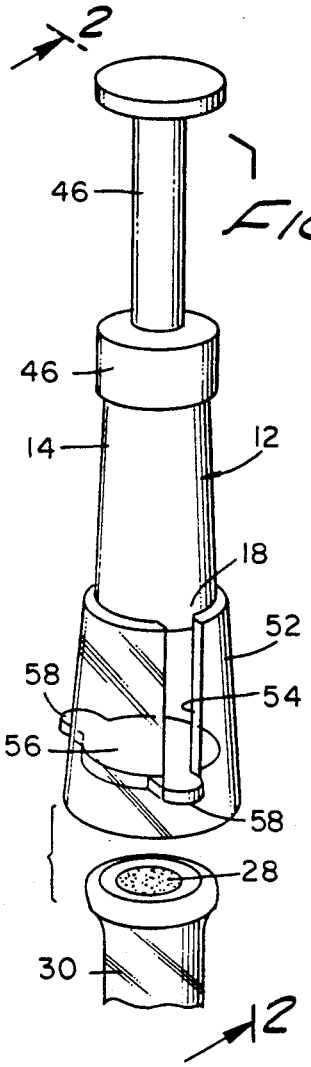
FIG. 1 is a generally perspective view of one form of the apparatus of the invention.
Figure 5:
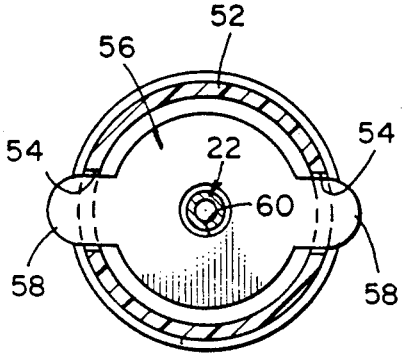
FIG. 5 is a cross-sectional view taken along lines 5—5 of FIG. 2.
Figure 10:
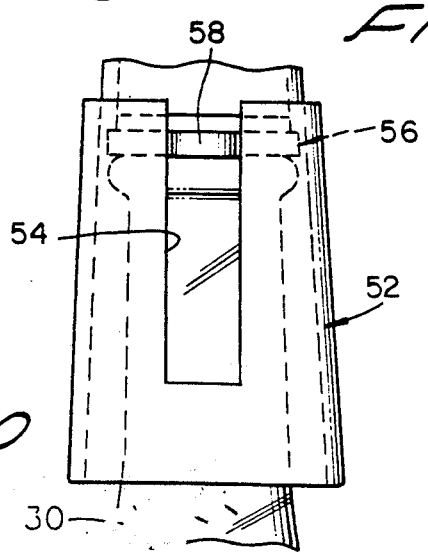
FIG. 10 is a fragmentary side elevational view, taken along lines 10—10 of FIG. 8, further illustrating the construction of the safety shield portion of the apparatus.

Forming an important aspect of the apparatus of the present invention is a downwardly depending safety skirt 52, which is connected proximate the lower end 18 of body 14. Skirt 52 is generally frustoconical in shape and functions to surround needle 22 in the manner shown in FIG. 1. As best seen in FIGS. 1, 5 and 10, skirt 52 is provided with oppositely disposed elongated slots 54, the purpose of which will presently be described.

Figure 2:
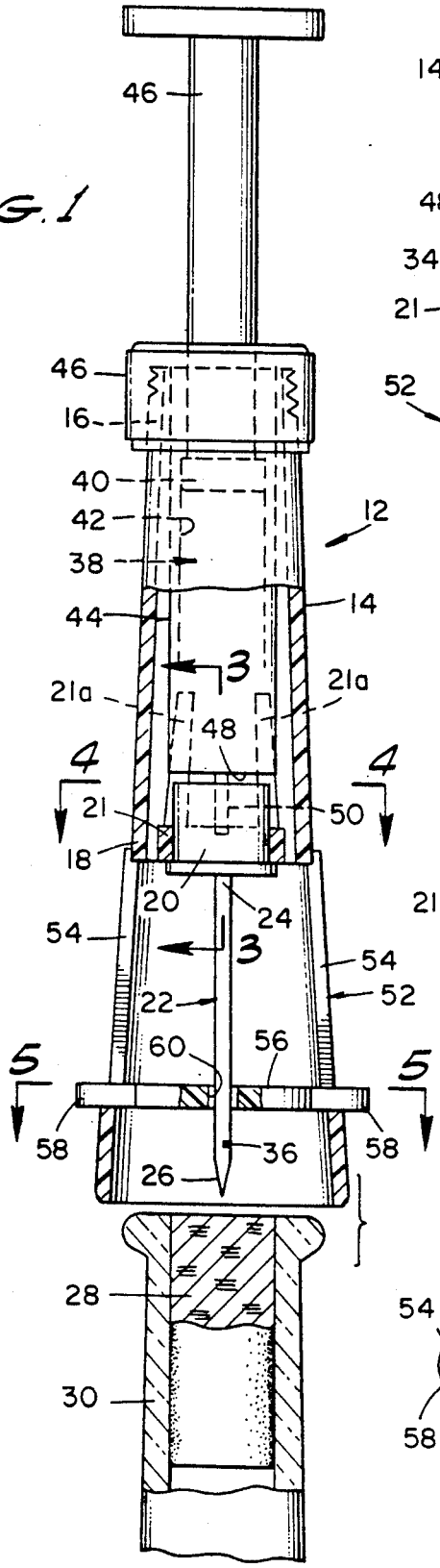
FIG. 2 is a greatly enlarged side elevational view, partly in section taken along lines 2—2 of FIG. 1 showing internal construction.
Figure 3:
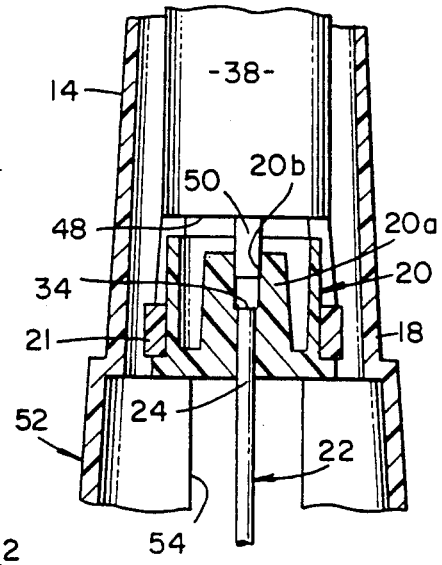
FIG. 3 is an enlarged cross-sectional view taken along lines 3—3 of FIG. 2

Associated with skirt 52 is a needle extracting means for at least partially retracting hollow needle 2 from the cork 28 following penetration of the cork by the needle and the subsequent removal of the cork from the top opening of bottle 30. In the form of the invention shown in FIGS. 1 through 10, the needle extracting means comprises a generally disk shaped member 56, having a pair of oppositely disposed ears 58, which are slidably receivable within slots 54 formed in the walls of skirt 52 (FIG. 5). As best seen in FIGS. 2 and 5, disk 56 is provided with a central aperture 60, which closely receives needle 22.

Figure 7:
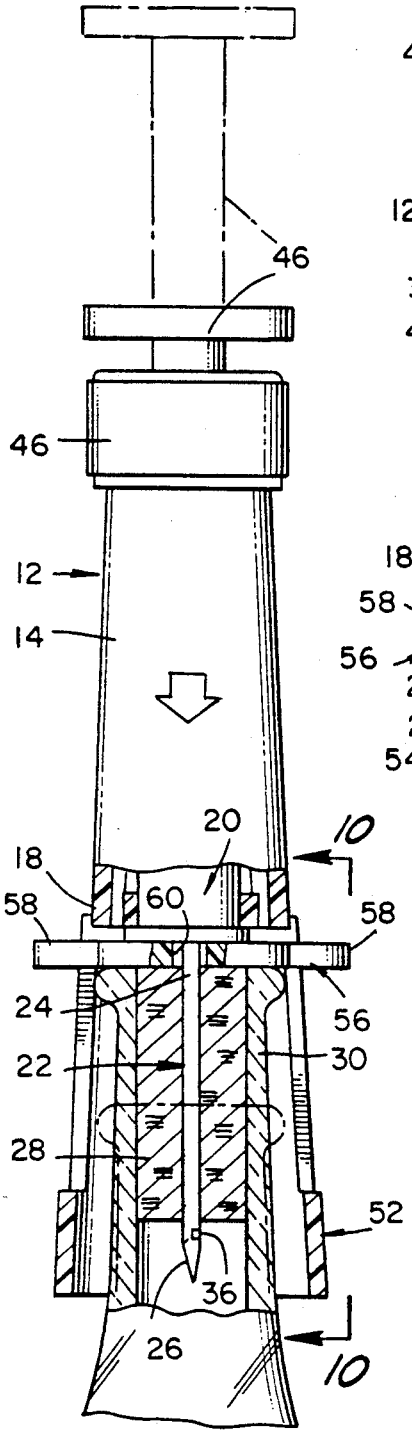
FIG. 7 is a side elevational schematic view, partly in cross-section illustrating penetration of the cork by the needle portion of the apparatus.

In using the apparatus of this first form of the invention, with the apparatus in the position shown in FIG. 2, the user grips body 14 with one hand and exerts a downward pressure which causes the needle 22 to penetrate the cork 28 in the manner shown in FIG. 7. As the needle 22 penetrates the cork, skirt portion 52 functions to at all times safely encapsulate the needle thereby preventing accidental needle puncture during the cork penetration step. As indicated in FIG. 2 needle 22 is of such a length that when it has penetrated cork 28, gas outlet 36 extends below the bottom of the cork and internally of bottle 30. By then depressing handle 46 in the manner illustrated in FIG. 8, piston 40 will move downwardly within chamber 42 causing compressed air to flow through the outlet 50 into passageway 32 of needle 22 and outwardly into the interior of the bottle in the manner indicated by the arrow in FIG. 8 designated by the numeral 64. Pressure build-up internally of the bottle will, of course, force the cork 28 upwardly into the position shown in FIG. 8. It is important to note that as the cork 28 moves upwardly in the manner shown in FIG. 8 relative to bottle 30, disk shaped member 56 will move upwardly within sleeve 52, with ears 58 sliding within slots 54 provided within skirt 52.

Figure 9:
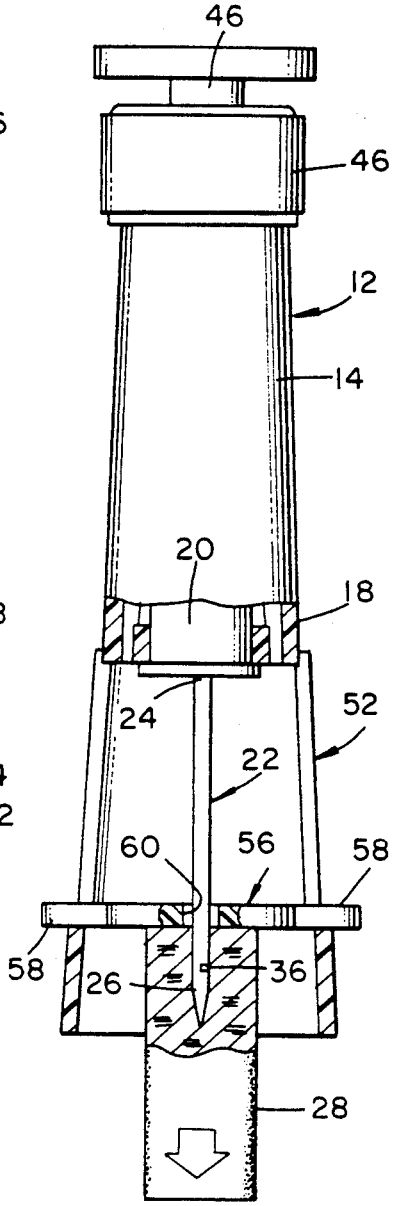
FIG. 9 is a side elevational view partly in cross-section similar to 8, illustrating the method of removal of the cork from the apparatus of the invention.

With the cork removed from the bottle it is of course necessary to, in some manner, safely withdraw the needle 22 from the cork. This is accomplished in a safe, easy and unique manner by the apparatus of the present invention, by sliding disk shaped member 56 downwardly within slots 54 to the position shown in FIG. 9. Downward movement of disk 56 is readily accomplished by grasping ears 58 with the fingers and exerting a downward pressure, while holding body portion 14 in place. As disk member 56 moves downwardly the cork will be forced downwardly away from the needle 22, so that it extends below the bottom of skirt 52, as illustrated in FIG. 9. With the cork in this position, it can be grasped and easily, and safely removed from the lower portion of the needle 22 and discarded or reinserted into the bottle as may be desired.

Figure 18:
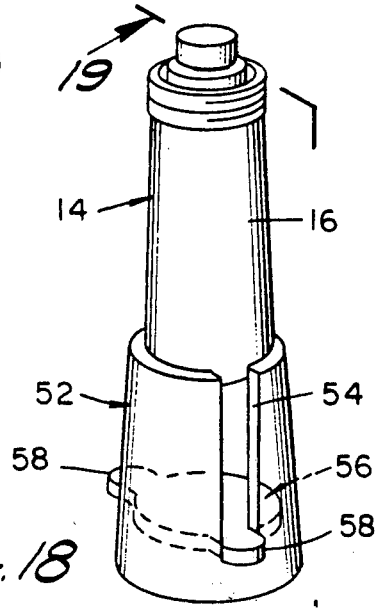
FIG. 18 is a fragmentary, perspective view of still another alternate form of the apparatus of the invention.

As will be discussed in greater detail hereinafter, and as illustrated in FIGS. 18 and 19, a pressurized gas container can be inserted into hollow body 14 and used in lieu of hand pump 38. Accordingly, if desired, pump 38 can be removed from body 14 and a pressurized gas container inserted in its place.

Turning now to FIGS. 11 through 17, another embodiment of the present invention is thereshown. This apparatus is similar in some respects to the previously described apparatus, and comprises a hollow body 70 having interconnected upper and lower portions 70*a* and 70*b* respectively; a sleeve 72 telescopically receivable over body 70; and a depending skirt 74 affixed to the lower portion of sleeve 72. Disposed intermediate sleeve 72 and skirt 74, is a cork engaging wall 76 having a centrally disposed aperture 78 for receiving a hollow needle 80. Needle 80 is connected to body 70 in a manner presently to be described.

Figure 11:
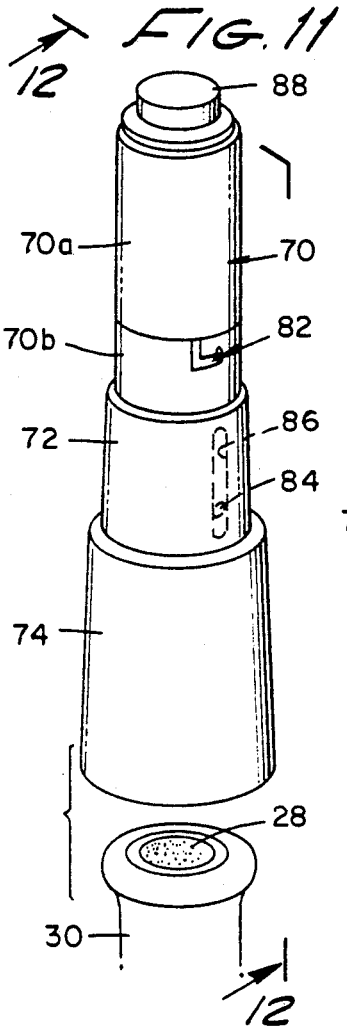
FIG. 11 is a generally perspective view of an alternate form of apparatus of the invention, using a pressurized gas container rather than a pump arrangement to pressurize the bottle with the cork in place.

As indicated in FIG. 11, upper and lower body portions 70*a* and 70*b* are interconnected by a bayonet type locking mechanism, generally designated by the numeral 82.

Figure 13:
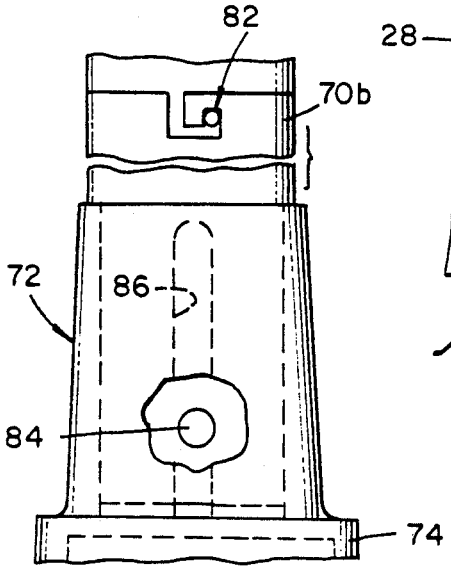
FIG. 13 is an enlarged, fragmentary, side elevational view taken along lines 13—13 of FIG. 12.
Figure 14:
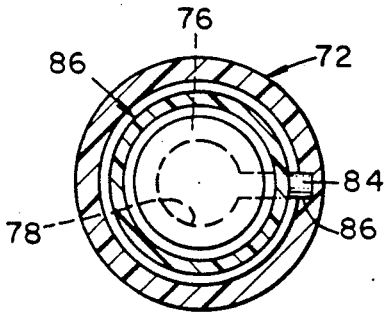
FIG. 14 is a cross-sectional view taken along lines 14—14 of FIG. 12.
Figure 16:
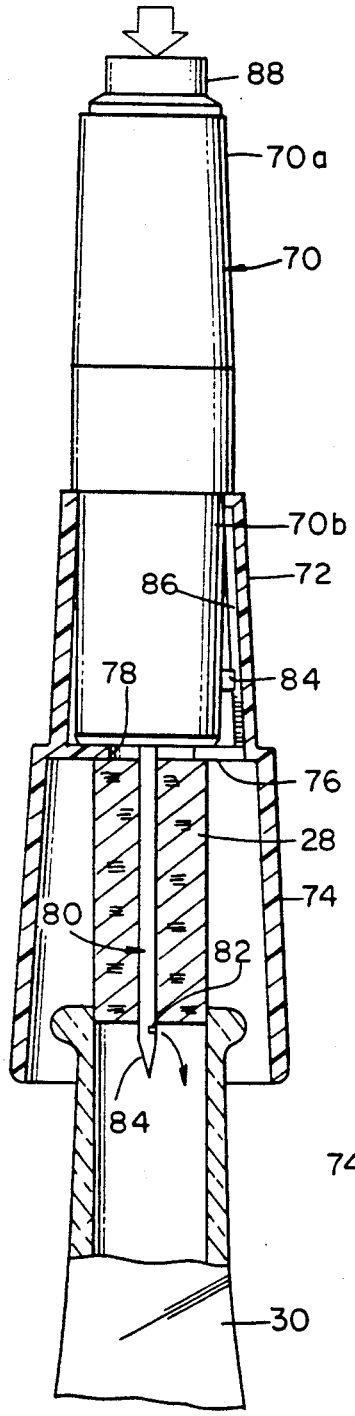
FIG. 16 is a side elevational view, partly in cross-section, similar to FIG. 15, but illustrating the pressurization step whereby the interior of the bottle is pressurized with gas from the gas cartridge.
Figure 17:
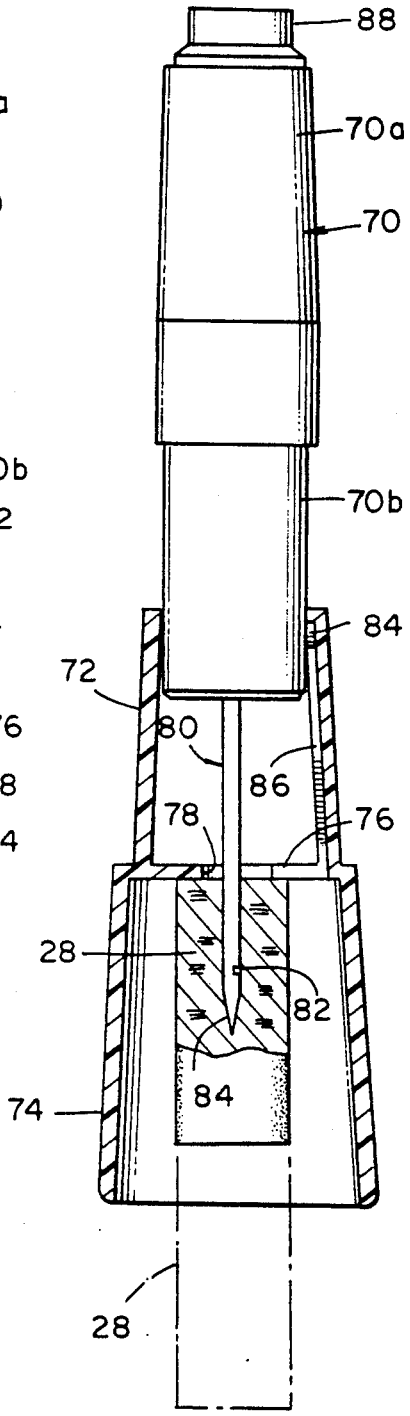
FIG. 17 is a side elevational view, partly in crosssection, similar to FIG. 16, but illustrating the appearance of the apparatus after partial withdrawal of the needle the cork.

Provided in the lower portion of body 70*b* is a protuberance 84 which is slidably receivable within an elongated slot 86 formed in the inner wall of sleeve 72 (FIGS. 11 and 13). With this construction sleeve 72 and skirt 70 can be moved up and down a limited distance with respect to body 70.

Like needle 22, needle 80 has a longitudinally extending gas passageway having a gas inlet located proximate the upper end thereof and a gas outlet 82 located proximate the lower, cork penetrating end 84.

Figure 15:
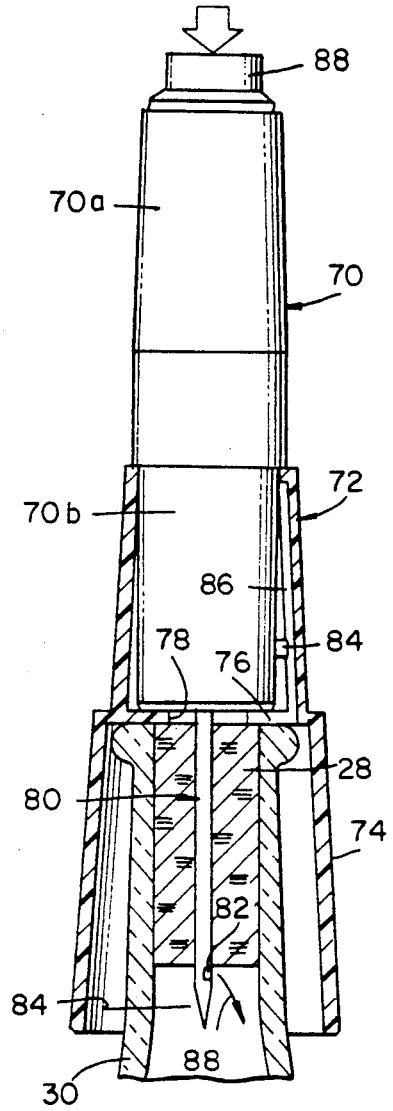
FIG. 15 is a side elevational view similar to FIG. 12, but illustrating the position of the apparatus after penetration of the cork by the hollow pressurizing needle.

Carried internally of hollow body 70 is a gas supply means for supplying gas under pressure to the inlet of hollow needle 80. In the embodiment of the invention shown in FIGS. 11 through 18 the gas supply means comprises a source of gas provide din the form of gas cylinder 86 containing an inert gas under pressure. (FIG. 12) Gas cylinder 86 has an outlet in communication with the gas passageway of needle 80 and includes valving means for selectively permitting the flow of gas under pressure from the gas cylinder into the gas passageway of needle 80. The valving means includes a thumb operated plunger 88 which extends from the top of body 70. When the plunger is depressed, as indicated in FIG. 15, a flow of gas into the needle and thence into the bottle 30 will result. The gas cylinder and the valving means are of a standard construction well known to those skilled in the art.

Forming an important aspect of the apparatus of this embodiment of the present invention is the downwardly depending safety skirt 74, which is connected proximate the lower end of sleeve 72. Skirt 74 is generally frustoconical in shape, and functions to surround needle 30 in the manner previously described and as shown in FIG. 12.

The needle extracting means of this second form of the invention for at least partially retracting hollow needle 80 form the cork 28 following penetration of the cork by the needle comprises sleeve 72 and cork engaging wall 76. The operation of the needle extracting means will become apparent from the discussion which follows.

Figure 12:
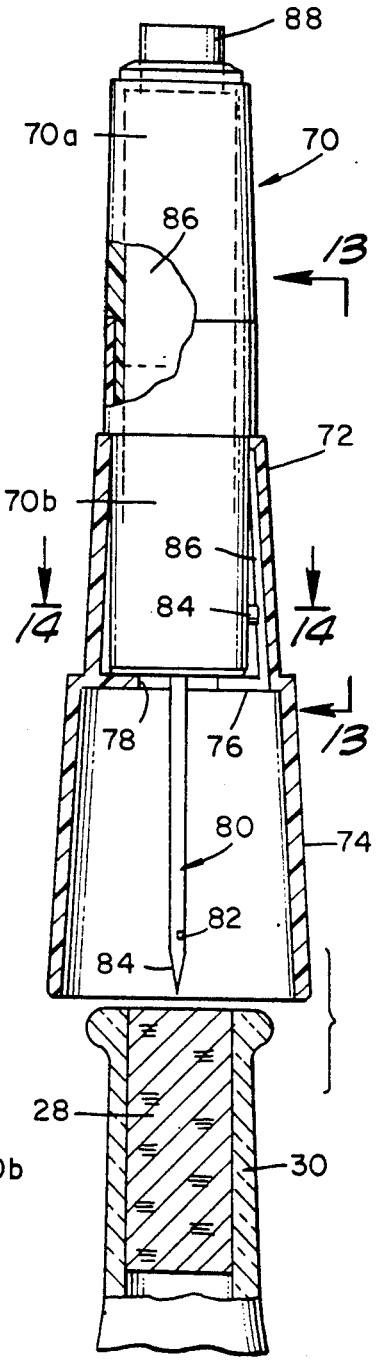
FIG. 12 is an enlarged side elevational view partially in cross-section taken along lines 12—12 of FIG. 11, illustrating the positioning of the apparatus to effect removal of the cork.

In using the apparatus of this second form of the invention, with the apparatus in the position shown in FIG. 12, the user grips body 70 with one hand and exerts a downward pressure which causes the needle 80 to penetrate the cork 28 in the manner shown in FIG. 15. As the needle 80 penetrates the cork, skirt portion 74 functions to at all times safely encapsulate the needle thereby preventing accidental needle puncture during the cork penetration step. As indicated in FIG. 15 needle 80 is of such a length that when it has penetrated cork 28, gas outlet 82 extends below the bottom of the cork and internally of bottle 30. By then depressing plunger 88 in the manner illustrated in FIG. 15, compressed gas within container 86 will flow through the outlet 82 into the passageway of needle 80 and outwardly into the interior of the bottle in the manner indicated by the arrow in FIG. 15 designated by the numeral 88. Pressure build-up internally of the bottle will, of course, force the cork 28 upwardly into the position shown in FIG. 16. It is important to note that as the cork 28 moves upwardly in the manner shown in FIG. 16 relative to bottle 30, the entire assemblage, including skirt 74, upwardly relative to the top of the bottle to the position shown in FIG. 16.

With the cork removed from the bottle it is, of course, necessary to withdraw the needle 80 from the cork. This is accomplished in a safe, easy and unique manner by the apparatus of the present invention, by gripping body 70 and members 72, 74 and 76 relative to body 70 to the position shown in FIG. 17. Downward movement of this assemblage of members is of course, guided by protuberance 84 sliding upwardly within slot 86. As the assemblage of members 72, 74 and 76 moves downwardly relative to body 70 the cork will be forced downwardly away from the needle 22, so that it extends below the bottom of skirt 74, when the assemblage is returned to the upward position shown in FIG. 16, with the cork in this position, it can be grasped and easily, and safely removed from the lower portion of the needle 80 and discarded or reinserted into the bottle as may be desired.

Turning now to FIGS. 18 and 19, the first described embodiment of the present invention using a gas cylinder rather than a hand operated air pump is thereshown. This apparatus is identical in most respects to the form of the invention shown in FIGS. 1 through 10 and like numbers are used in FIGS. 18 and 19 to identify like components.

The apparatus of this embodiment of the invention comprises a hollow body 14 having upper and lower ends 16 and 18 respectively; a needle support 20 connected to hollow body 14 proximate the lower end thereof; and an elongated needle 22 having an upper end 24 connected to needle support 20. Needle 22 is provided with a lower, cork penetrating end 26 for penetrating the cork 28 which seals the top of the bottle. Needle 22 has a longitudinally extending gas passageway having a gas inlet located proximate the upper end thereof and a gas outlet 36 located proximate the lower, cork penetrating end 26.

Carried internally of hollow body 14, is a gas supply means for supplying gas under pressure to inlet 34 of hollow needle 22. In the embodiment of the invention shown in FIGS. 18 and 19, the gas supply means comprises a source of gas provided in the form of a gas cylinder 86 of the character illustrated in FIG. 12 and previously described herein. Gas cylinder 86 is directly interchangeable with air pump 38 and can be used alternately with the air pump. Operating plunger 88 extends upwardly from housing 14 through the externally threaded upper end of body 14. A cap 46 of the character shown in FIG. 1 can be threadably interconnected with body 14 proximate the upper end thereof if desired, or the cap can be set aside. Gas cylinder 86 includes a gas outlet 92 adapted to be closely received within needle support 20 which includes an upstanding central portion 20*a* having an axial bore adapted to receive gas outlet 92. With this construction, when plunger 88 is depressed gas under pressure will be forced through gas outlet 92 into the passageway of hollow needle 22 and thence outwardly through outlet 36.

The apparatus of the form of the present invention shown in FIGS. 18 and 19 also comprises a downwardly depending safety skirt 52, and a needle extracting means identical to that previously described herein in connection with the description of the first form of the invention.

In using the apparatus of this third form of the invention, the bottle is pressurized by depressing plunger 88 and the cork is removed from the needle 22 using disk 56, in the same manner as previously described. In other words the apparatus shown in FIGS. 18 and 19 operates in the same manner as the apparatus shown in FIGS. 1 through 10 save that a gas cylinder has taken the place of the hand pump as the pressure source.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A cork removal apparatus for removing a cork from a bottle comprising;

(a) a body;

(b) an elongated hollow needle depending from said body for penetrating the cork;

(c) gas supply means carried by said body for supplying gas under pressure to said hollow needle;

(d) a skirt depending from said body, said skirt surrounding said hollow needle and including a pair of oppositely disposed elongated slots; and (e) needle extracting means associated with said skirt for a least partially retracting said hollow needle from the cork following penetration of the cork by said hollow needle, said needle extracting means comprising a generally disk shaped member having a pair of oppositely disposed ears slidably receivable with said slots of said skirt and including a centrally disposed aperture for receiving said hollow needle.

2. An apparatus as defined in claim 1 in which said gas supply means comprises an air pump means carried by said body for supplying air under pressure to said hollow needle.

3. An apparatus as defined in claim 1 in which said gas supply means comprises a cylinder containing gas under pressure, said cylinder including a gas outlet in communication with said hollow needle.

4. A cork removal apparatus for removing a cork form a bottle comprising:

(a) a body;

(b) an elongated hollow needle depending from said body for penetrating the cork;

(c) gas supply means carried by said body for supplying gas under pressure to said hollow needle;

(d) a skirt depending from said body, said skirt surrounding said hollow needle; and (e) needle extracting means associated with said skirt for at least partially retracting said hollow needle from the cork following penetration of the cork by said hollow needle, said needle extracting means comprising:

(i) a sleeve member connected to said skirt, said sleeve member being telescopically receivable over said body for movement between a first position wherein said hollow needle fully penetrates the cork to a second position wherein said hollow needle is partially retracted from the cork; and (ii) a cork engaging wall disposed intermediate said sleeve member and said skirt, said cork engaging wall having a centrally disposed aperture for receiving said hollow needle.

* * * * *